US009677281B2

(12) United States Patent
Standeford et al.

(10) Patent No.: US 9,677,281 B2
(45) **Date of Patent: *Jun. 13, 2017**

(54) METHOD OF MANUFACTURING GRANULE COATED ASPHALTIC ARTICLES

(71) Applicant: FIRESTONE BUILDING PRODUCTS CO., LLC, Indianapolis, IN (US)

(72) Inventors: Joseph Standeford, Indianapolis, IN (US); Wensheng Zhou, Carmel, IN (US); Lance Black, Indianapolis, IN (US)

(73) Assignee: Firestone Building Products Company, LLC, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/657,189

(22) Filed: Mar. 13, 2015

(65) Prior Publication Data

US 2015/0184391 A1 Jul. 2, 2015

Related U.S. Application Data

(63) Continuation of application No. 13/860,565, filed on Apr. 11, 2013, now Pat. No. 8,993,047, which is a continuation of application No. 12/983,687, filed on Jan. 3, 2011, now Pat. No. 8,435,599.

(60) Provisional application No. 61/291,485, filed on Dec. 31, 2009.

(51) Int. Cl.

| | |
|---|---|
| ***B05D 3/12*** | (2006.01) |
| ***E04D 1/20*** | (2006.01) |
| ***E04D 5/12*** | (2006.01) |
| ***D06N 5/00*** | (2006.01) |
| ***B05D 1/30*** | (2006.01) |
| ***B05D 1/36*** | (2006.01) |
| *E04D 1/00* | (2006.01) |

(52) U.S. Cl.

CPC ..... *E04D 5/12* (2013.01); *B05D 1/30* (2013.01); *B05D 1/36* (2013.01); *B05D 3/12* (2013.01); *D06N 5/003* (2013.01); *E04D 1/20* (2013.01); *B05D 2252/02* (2013.01); *B05D 2425/01* (2013.01); *B05D 2451/00* (2013.01); *E04D 2001/005* (2013.01)

(58) Field of Classification Search

CPC ..... E04D 1/20; E04D 5/12; E04D 2001/0005; B05D 3/12; B05D 1/30; B05D 1/36

USPC ..... 427/174, 186

See application file for complete search history.

(56) References Cited

U.S. PATENT DOCUMENTS

| | | | | |
|---|---|---|---|---|
| 2,160,787 | A | 5/1939 | Reade | |
| 4,478,869 | A * | 10/1984 | Brady | B05C 19/06 118/308 |
| 5,382,291 | A | 1/1995 | Olioso | |
| 5,405,647 | A | 4/1995 | Grubka et al. | |
| 5,565,239 | A * | 10/1996 | Pike | E04D 5/02 427/186 |

(Continued)

*Primary Examiner* — William Phillip Fletcher, III

(74) *Attorney, Agent, or Firm* — Thomas R. Kingsbury; Arthur M. Reginelli

(57) ABSTRACT

A method of manufacturing a granule coated asphaltic article comprising the steps of applying liquid asphalt to a reinforcing sheet to create an asphaltic sheet, the asphaltic sheet having a top surface and a bottom surface; bending the asphaltic sheet to form an arcuate top surface of the sheet; and applying a coating of granules over the arcuate top surface of the asphaltic sheet.

12 Claims, 2 Drawing Sheets

(56) References Cited

U.S. PATENT DOCUMENTS

| | | | | |
|---|---|---|---|---|
| 5,573,810 | A | 11/1996 | Grubka | |
| 6,582,760 | B2 | 6/2003 | Aschenbeck | |
| 6,679,308 | B2 | 1/2004 | Becker et al. | |
| 6,790,307 | B2 * | 9/2004 | Elliott | B05D 1/30 118/314 |
| 6,933,007 | B2 | 8/2005 | Fensel et al. | |
| 7,638,164 | B2 | 12/2009 | Aschenbeck | |
| 8,435,599 | B1 * | 5/2013 | Standeford | D06N 5/003 427/186 |
| 8,993,047 | B2 * | 3/2015 | Standeford | 427/186 |
| 2013/0034697 | A1 | 2/2013 | Shiao et al. | |

* cited by examiner

METHOD OF MANUFACTURING GRANULE COATED ASPHALTIC ARTICLES

This application is a continuation application of U.S. Pat. No. 8,993,047, filed on Apr. 11, 2013, U.S. Pat. No. 8,435,599, filed on Jan. 3, 2011, which claims priority of U.S. Provisional Application Ser. No. 61/291,485 filed Dec. 31, 2009, which are incorporated herein by reference in their entirety.

FIELD OF THE INVENTION

Embodiments of the present invention are directed toward a method of manufacturing asphaltic articles coated with granules. More particularly, one or more embodiments of the invention are directed toward a method that produces asphaltic articles having improved coverage of the granules.

BACKGROUND OF THE INVENTION

Asphaltic roofing membranes are often employed to cover flat or low sloped roofs. These membranes are typically installed by unrolling a roll of material on a roof surface and then heat seaming adjacent membranes together to form an impervious water barrier on the roof surface.

As part of the manufacturing process, the asphaltic roofing membranes are often coated with granular material. Among the benefits associated with the use of these granules is the ability to reflect solar radiation, thereby maintaining a cooler roof surface, protect the asphalt compounds by blocking the sunlight and UV rays, provide a desired color for cosmetic purposes and provide a small degree of fire resistance. In addition, the granules protect the asphaltic roofing membrane from natural elements such as precipitation and from foot traffic across the roof. Current production methods often utilize gravity by dropping the granules from a hopper onto a tacky asphaltic sheet where the granules are adhered.

Current manufacturing methods for asphaltic articles suffer from a number of disadvantages. For example, it is difficult to obtain an even, consistent, and thorough coverage of the granules over the asphaltic sheet. Even in those manufacturing methods employing various stages of granule application, the desired coverage of the asphaltic sheet is rarely obtained. Consistent and thorough granule coverage is particularly important to highly reflective asphaltic articles, since uncovered portions of the article provide significantly reduced reflectivity.

Thus, there is a need for an improved method of manufacturing asphaltic articles that have a more even, consistent and/or thorough coverage of a granule coating.

SUMMARY OF THE INVENTION

One or more embodiments of the present invention provide a method of manufacturing a granule coated asphaltic article comprising the steps of applying liquid asphalt to a reinforcing sheet to create an asphaltic sheet, the asphaltic sheet having a top surface and a bottom surface; bending the asphaltic sheet to form an arcuate top surface of the sheet; and applying a coating of granules over the arcuate top surface of the asphaltic sheet.

One or more embodiments of the present invention also provides a method of manufacturing a granule coated asphaltic article comprising the steps of applying a first coating of granules to a top surface of an asphaltic sheet; and applying a second coating of granules to the arcuate top surface of the asphaltic sheet, wherein the granules forming the first coating of granules have a first weight average granule size, the granules forming the second coating of granules have a second weight average granule size, and the ratio of the first weight average granule size to the second weight average granule size is between approximately 1.6 and 4.0.

One or more embodiments of the present invention also provides a method of manufacturing a granule coated asphaltic article comprising the steps of applying a first coating of granules to a top surface of an asphaltic sheet while the asphaltic sheet is in a flat position; bending the asphaltic sheet to form an arcuate top surface of the sheet; and applying a second coating of granules to the arcuate top surface of the asphaltic sheet, wherein the granules forming the first coating of granules have a first weight average granule size, the granules forming the second coating of granules have a second weight average granule size, and the ratio of the first weight average granule size to the second weight average granule size is greater than 2.0.

DETAILED DESCRIPTION OF THE ILLUSTRATIVE EMBODIMENTS

Figure 1:
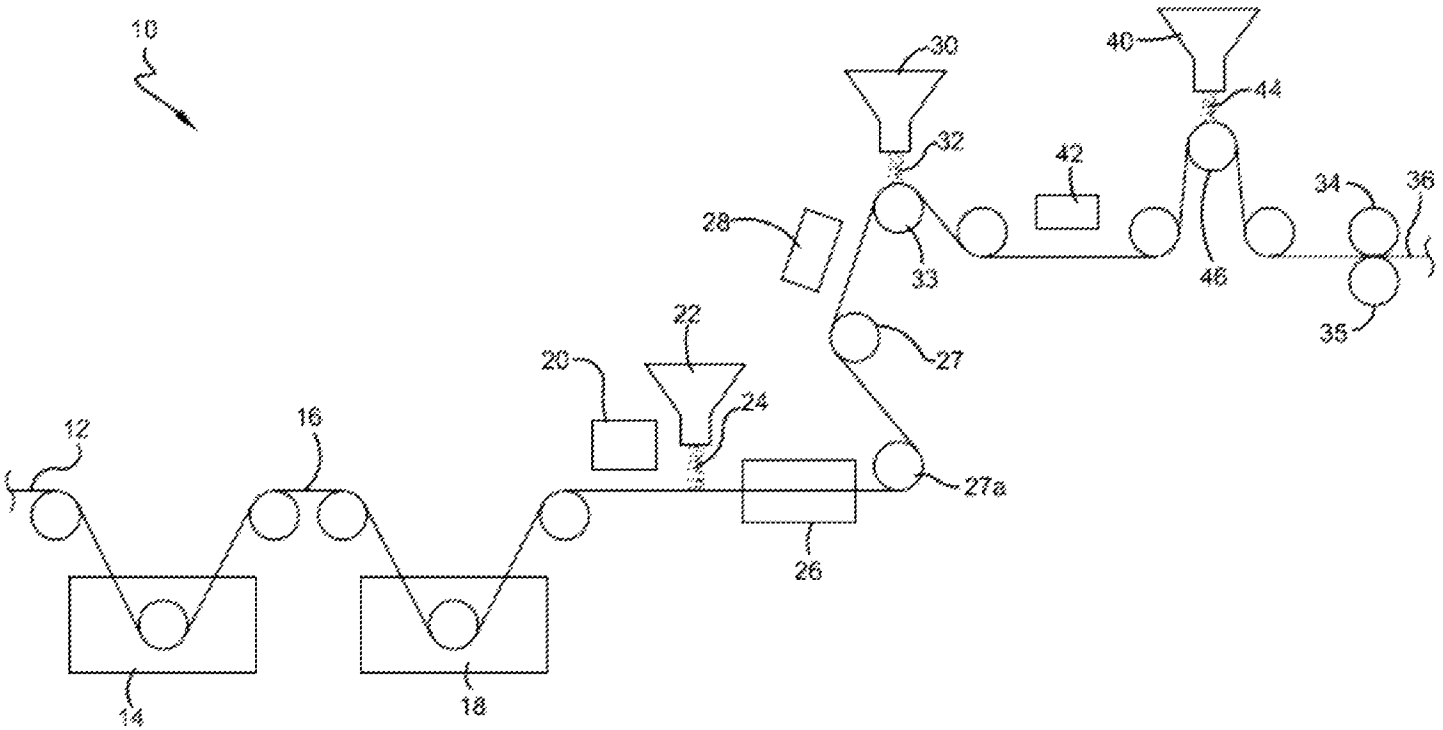
FIG. 1 is a schematic view of an asphaltic article manufacturing line according to the concepts of the present invention.

Embodiments of the present invention are based, at least in part, on the discovery of a process for applying granular material to an asphaltic sheet, wherein at least a portion of the granular material is applied to an upper surface of the sheet that is manipulated into an arcuate orientation while the sheet passes over a curved or radiused surface. In one or more embodiments, the granular material is deposited directly onto the asphaltic material, without an intermediary layer or material. In particular embodiments, the process includes at least two steps wherein granular material is applied to a surface of an asphaltic sheet, and the second step of applying the granular material includes applying the granules to an arcuate upper surface of the sheet. In these or other embodiments, the size of the granular material applied in the second step may be smaller than the size of granular material applied in the first step. While the prior art contemplates multiple steps for applying granules (even those employing granules of different size), it has unexpectedly been discovered that the coverage rate can be increased, as manifested by increase reflectivity of the coated membrane, by practice of one or more embodiments of the present invention.

One or more embodiments of the present invention are directed toward a method of producing asphaltic sheets having a granule coating on at least one surface thereof. In particular embodiments, the sheet may form a roofing shingle, which is conventionally used on residential buildings with relatively high-sloped roofs. In other embodiments, the asphaltic sheets form modified asphalt membranes, which include those membranes that are conventionally used on commercial buildings that have flat or low-sloped roofs. Examples of modified asphalt membranes are disclosed in U.S. Pat. Nos. 6,492,439, 6,486,236, 4,835,199, 7,442,270, 7,146,771, 7,070,843, 4,992, 315, and 6,924,015. As used herein, the term asphaltic sheet may refer to asphaltic shingles, membranes or other planar asphaltic articles known to those skilled in the art.

One or more embodiments of the present invention are directed toward methods of forming highly reflective asphaltic sheets by applying highly reflective granules to the asphaltic sheet. In other embodiments, any conventional granules may be applied to the asphaltic sheet. Granules applied to asphaltic sheets for use in roofing environments serve a number of functions, including protecting the underlying asphalt from damage due to exposure to light, in particular ultraviolet (UV) light, and from deterioration by photodegradation. In addition, the granules improve fire resistance and weather characteristics of the asphaltic sheet. Furthermore, granules of specific or varying colors may be utilized to improve the aesthetics of the asphaltic sheet. The granules may be uncoated or may be coated.

The granules, also referred to as particles or mineral materials, may include any known or conventional granular material. The method of the present invention should not be limited by the composition or geometry of the granules applied to the asphaltic sheet unless otherwise indicated. Generally, conventional granules include slate or rock granules either in natural form or colored by ceramic processes. It is contemplated that any mineral material can be used in the process of the present invention. Suitable base granules can be selected from a wide class of relatively porous or non-porous and weather-resistant rock or mineral materials. Suitable minerals include trap rocks, slates, argillite, greystone, green-stone, quartz, quartzite, certain granites or certain synthetic granules made from clay or other ceramics. U.S. Pat. No. 5,380,552 identifies aluminosilicate as a preferred granule material, which may be coated to provide desired characteristics.

In certain embodiments where reflective granules are used, the asphaltic articles are advantageously characterized by exhibiting a high degree of solar reflectivity. In one or more embodiments, the asphaltic or bituminous products of this invention is characterized by exhibiting a solar reflectance, as defined and determined by the EnergyStar rating or California Title 24 (Cool Roof Rating Council test CRRC-1 in conjunction with ASTM C1549), of at least 65%, in other embodiments at least 68%, in other embodiments at least 70%, in other embodiments at least 71%, and in other embodiments at least 72% reflectivity.

As is generally known, the roofing articles are generally planar structures. For example, modified asphalt membranes are generally in the form of a sheet that is rolled for storage and transport. Upon installation, these membranes are unrolled and adjacent sheets can be heat welded together or sealed with hot asphalt or cold adhesive to form a water-impervious barrier on the top of the roof.

In a manner similar to conventional practice, a planar surface of the membrane is coated with granules. The coated surface is typically the surface that is exposed to the environment when installed on a roof, and therefore it may be referred to as the top surface. The opposite planar surface, which may be referred to as the bottom surface, is typically not coated with granules and therefore may be devoid or substantially devoid of granules. The bottom surface may include a coating to prevent sticking of the asphalt during rolling, storage and shipping. Examples of non-stick coatings include, but are not limited to, release liners and sand.

In one or more embodiments, the method of the present invention first includes the step of providing a reinforcing sheet 12. Reinforcing sheet 12 may be in the form of a planar sheet, and may be provided in the form of a roll. In one or more embodiments, reinforcing sheet 12 may be a scrim, or fiberglass mesh sheet, as is known in the art. Useful scrims include those that are commercially available. For example, fiberglass scrims are available under the trade name STYLE™ 930120 (Milliken & Co.; Spartanburg, S.C.) and also available from J. P. Stevens (Greenville, S.C.). In other embodiments, reinforcing sheet 12 may be an organic felt or a combination polyester and glass mat. Useful polyester mats are available from Freudenberg & Co. of Germany.

Reinforcing sheet 12 is drawn through an asphalt coater 14, which applies hot liquid asphalt to the reinforcing sheet 12 to create an asphaltic sheet 16. It is contemplated that the liquid asphalt may include additional polymers and fillers, and therefore may also be referred to as a liquid asphalt compound. In one or more embodiments, asphalt coater 14 may be a reservoir of hot liquid asphalt. In other embodiments, asphalt coater 14 may include spraying apparatus to coat the reinforcing sheet 12 with liquid asphalt. In yet other embodiments, reinforcing sheet 12 may be coated with hot liquid asphalt by any alternative methods known to persons having ordinary skill in the art.

In one or more embodiments, asphaltic sheet 16 may be drawn through a cooling station 18 to cool the hot asphalt and create a more stable substrate for the application of granules. In one or more embodiments, cooling station 18 may include a water reservoir through which asphaltic sheet 16 is drawn. In certain embodiments, asphaltic sheet 16 may float across a water reservoir to cool the sheet while allowing the top surface to retain a higher temperature than the bottom surface. In other embodiments, cooling station 18 may include other cooling mechanisms known to those skilled in the art.

In or more embodiments, the method of manufacturing a granule coated asphaltic sheet may next include the step of heating one surface of asphaltic sheet 16 with a heating element 20. In one or more embodiments, heating element 20 may heat a top surface of asphaltic sheet 16. Heating element 20 may be any apparatus known to those skilled in the art capable of applying heat to a surface of the asphaltic sheet, and may include, for example, a flame bar, a hot air blower, or an infrared heating device. Heating element 20 increases the tackiness of the top surface of the sheet by increasing the temperature on one surface of asphaltic sheet 16.

In one or more embodiments, cooling station 18 may be omitted and asphaltic sheet 16 may proceed from asphalt coater 14 to a first granule dropping station, as discussed below. The omission of cooling station 18 may alleviate any need for heating element 20 because the asphaltic sheet 16 will remain sufficiently hot and tacky for granule application. In one or more embodiments, asphaltic sheet 16 may have a surface temperature of between approximately 250 and 450° F. prior to a first application of granules, in other embodiments between approximately 275 and 400° F., and in other embodiments between approximately 325 and 375° F. In certain embodiments, asphaltic sheet 16 may have a surface temperature of approximately 350° F. prior to a first application of granules.

In one or more embodiments, asphaltic sheet 16 is passed beneath a hopper 22 containing granules 24 immediately following the step of heating the top surface by heating element 20 or after emerging from asphalt coater 14. The granules 24 adhere to asphaltic sheet 16 by virtue of the tackiness of the hot asphaltic surface. Hopper 22 deposits a predetermined amount of granules 24 onto asphaltic sheet 16. In one or more embodiments, hopper 22 may be a fluted roll hopper having a gated output orifice, as is well known in the art. In one or more embodiments, hopper 22 may be a vibratory feeder, which deposits a more uniform and consistent volume of granules on asphaltic sheet 16. The rate at which granules 24 are dispensed from hopper 22 may be adjusted to achieve optimum coverage of asphaltic sheet 16.

In one or more embodiments, the granules 24 applied to asphaltic sheet 16 from hopper 22 may be full grade granules, also referred to as Grade No. 11. Particle size, by standard characterization techniques, generally refers to largest axis (e.g., diameter of a spherical particle) of the granule, which may also be referred to as equivalent spherical diameter. Granule size, or particle size, may also be described with reference to the weight average particle size, as will be understood by those skilled in the art.

According to U.S. Pat. No. 6,238,794, full grade granules corresponds to −10/+35 U.S. mesh size. Alternatively, as stated in U.S. Pat. No. 6,933,007, industry standard granules are typically referred to as 8×40 U.S. mesh whereas the average particle size corresponds to about 19 US mesh (i.e. 937 mm sieve opening). In one or more embodiments, the granules are characterized by particles, agglomerates, or mixtures thereof ranging in size according to from about −3½ to about +70 mesh, or in other embodiments from about −4 to about +35 mesh. In other words, the particles, on average, are of sufficient size so that 90% or more of the material will pass through a 3½ -mesh sieve (particles smaller than 5.66 mm) and be retained by a 70-mesh sieve (particles larger than 0.210 mm).

In one or more embodiments, granules 24 may have a weight average granule size of greater than 1.0 mm, in other embodiments greater than 1.1 mm, and in yet other embodiments greater than 1.2 mm. In certain embodiments, granules 24 may have a weight average granule size of between approximately 0.88 and 1.56 mm. In certain embodiments, granules 24 may have a weight average granule size of approximately 1.22 mm.

Following application of granules 24, asphaltic sheet 16 may optionally proceed to a loose granule removal station 26 where excess granules are dislodged and removed from asphaltic sheet 16. Excess and non-adhered granules that are lying loosely on the top surface of asphaltic sheet 16 may be removed by the loose granule removal station 26. Loose granule removal station 26 may also act to compact the granules that have been applied to the asphaltic sheet. Any mechanism known to those skilled in the art may be employed to shake, vibrate or otherwise agitate asphaltic sheet 16 to dislodge and remove the loose granules, such as, for example, a beater bar or brush. In one or more embodiments, granules 24 that are removed by loose granule removal station 26 may be collected and reused.

In one or more embodiments, asphaltic sheet 16 having a first coating of granules 24 thereon may be routed through a series of rollers 27 to cause asphaltic sheet 16 to be inverted or oriented generally vertically. The routing of asphaltic sheet 16 through rollers 27 may cause any remaining granules 24 that are not fully adhered to asphaltic sheet 16 to be dislodged. Any configuration of rollers 27 may be used to cause manipulation of asphaltic sheet 16 and removal of un-adhered granules 24. In one or more embodiments, rollers 27 may be cooling rollers that act to lower the temperature of asphaltic sheet 16.

In one or more embodiments, asphaltic sheet 16, including the first coating of granules 24, may pass around a slating drum, also referred to as a compressing roller, 27*a* that presses or compresses the granules into the asphaltic sheet. Slating drum 27*a* is part of the series of rollers 27 that define a path of travel for asphaltic sheet 16. Asphaltic sheet 16 is routed around the slating drum 27*a* so that the top surface having granules 24 thereon contacts the slating drum 27*a*. In one or more embodiments, tension may be applied to asphaltic sheet 16 as it passes around slating drum 27*a*, thereby compressing the granules 24 into the surface of asphaltic sheet 16. The tension in asphaltic sheet 16 may be varied to achieve a desired compression at slating drum 27*a*.

In one or more embodiments, asphaltic sheet 16 having a first coating of granules 24 thereon may then pass beneath or past a second heating element 28 to reheat the top surface of asphaltic sheet 16. Reheating of the top surface may be advantageous to increase the tackiness of the asphaltic composition prior to applying a second coating of granules. In other embodiments, asphaltic sheet 16 having a first coating of granules 24 thereon may proceed to a second granule application station without being heated. In these or other embodiments, the top surface of asphaltic sheet 16 has a surface temperature of at least approximately 200° F. prior to receiving a second application of granules, as discussed below.

In one or more embodiments, asphaltic sheet 16 may then pass beneath a second hopper 30 from which a second coating of granules 32 is dispensed. In certain embodiments, second hopper 30 and second granule coating 32 may be substantially identical to hopper 22 and the first coating of granules 24. In other embodiments, granules 32 may be smaller in size than granules 24 so as to better fill the voids left on the asphaltic sheet by the first application of granules.

In one or more embodiments, granules 32, dispensed from second hopper 30, may have a particle size of less than 1.0 mm, in other embodiments less than 0.8 mm, and in still other embodiments less than 0.6 mm. In one or more embodiments, granules 32 may have a weight average granule size less than 0.55 mm, in other embodiments less than 0.5 mm, and in yet other embodiments less than 0.45 mm. In one or more embodiments, granules 32 may have a weight average granule size of between approximately 0.32 and 0.51 mm. In certain embodiments, granules 32 may have a weight average granule size of approximately 0.42 mm.

In one or more embodiments, the ratio of the weight average granule size of granules 24 forming the first coating to the weight average granule size of granules 32 forming the second coating is at least 1.6, in other embodiments a ratio of at least 1.8, in other embodiments a ratio of at least 2.0, in yet other embodiments a ratio of at least 2.2. In one or more embodiments, the ratio of the weight average granule size of granules 24 forming the first coating to the weight average granule size of granules 32 forming the second coating is less than 4.0, in other embodiments a ratio of less than 3.5, in other embodiments a ratio of less than 3.0,in yet other embodiments a ratio of less than 2.9. In certain embodiments, the weight average granule size ratio between the granules 24 of the first drop and the granules 32 of the second drop may be approximately 2.9. In one or more embodiments, the granules 32 forming the second granule coating have a weight average particle size that is less than half the particle size of the granules forming the first granule coating 24.

In one or more embodiments, second hopper 30 may be positioned over a peak roller 33, from which asphaltic sheet 16 extends downward in both directions. The planar portions of asphaltic sheet 16 on either side of peak roller 33 form an angle of less than 180°. In other words, asphaltic sheet 16 is bent over peak roller 33 to create an arcuate upper surface of the sheet. Granules 32 may thereby be dispensed over the upper arcuate surface of asphaltic sheet 16 as it curves or bends around peak roller 33. In one or more embodiments, granules 32 may be dispensed at the apex of the arcuate upper surface of asphaltic sheet 16.

As used herein, "arcuate upper surface" refers to an upper surface of the sheet that is manipulated into an arcuate orientation while the sheet passes over a radiused surface. The asphaltic sheet conforms to the underlying surface to form a radiused, or arcuate, upper surface of the sheet. In the embodiments discussed herein the radiused surface is in the form of a roller, and the asphaltic sheet conforms to a portion of the upper surface of the roller as it passes over or around the roller. It will be appreciated by those skilled in the art that a variety of methods may be used to manipulate asphalt sheet 16, and the upper surface of asphalt sheet 16, into an arcuate or radiused orientation. The invention should not be limited by the method utilized unless otherwise claimed.

In one or more embodiments, the radiused surface, i.e. peak roller 33, may have a radius of between 5.0 and 35.0 inches. Thus, in these embodiments, asphaltic sheet 16 is manipulated to have an arcuate upper surface having a radius of between approximately 5.0 and 35.0 inches. The radius of peak roller 33, and the stretching of the top surface of asphaltic sheet 16 as is passes over peak roller 33, may be adjusted to improve coverage of the second coating of granules 32 based upon coverage achieved by the first coating 24 and the particle size of the granules 32 forming the second coating.

Due to the natural tendency for the upper surface of asphaltic sheet 16 to stretch and the inner surface of asphaltic sheet 16 to compress as it travels over peak roller 33, the areas on asphaltic sheet 16 not covered by the first coating of granules 24 will expand. The second coating of granules 32 is applied to the arcuate upper surface of asphaltic sheet 16 as it passes over peak roller 33, thereby increasing the surface area of exposed asphalt for the granules 32 to adhere.

In one or more embodiments, asphaltic sheet 16 may proceed through an additional vibration station, an additional heating element, and/or a third hopper and granule dispensing station after receiving the second coating of granules 32. It is also contemplated that additional granule dispensing stations may be used if necessary to achieve a full and consistent coating of granules on asphaltic sheet 16.

In the particular embodiment shown in FIG. 1, asphaltic sheet 16 proceeds from second hopper 30 to a third hopper 40 positioned downstream from the second hopper 30. Prior to passing beneath the third hopper 40, asphaltic sheet 16 may passes beneath a third heating element 42 to heat the top surface thereof and thereby increase the tackiness of the underlying asphalt. In one or more embodiments, third heating element 42 may heat the top surface of asphaltic sheet 16 to a temperature of greater than 125° F. In certain embodiments, third heating element 42 may heat the top surface of asphaltic sheet 16 to a temperature of between approximately 125° F. and 150° F.

In one or more embodiments, third hopper 40 may apply a third coating of granules 44 over asphaltic sheet 16. In certain embodiments, granules 44 dropped from third hopper 40 may be substantially identical to the granules 32 dropped from second hopper. In other embodiments, granules 44 dispensed from third hopper 40 may have a particle size that is less than the particle size of the granules 32 dispensed from second hopper 30.

In one or more embodiments, granules 44, dispensed from second hopper 40, may have a particle size of less than 1.0 mm, in other embodiments less than 0.8 mm, and in still other embodiments less than 0.6 mm. In one or more embodiments, granules 32 may have a weight average granule size less than 0.55 mm, in other embodiments less than 0.5 mm, and in yet other embodiments less than 0.45 mm. In one or more embodiments, granules 32 may have a weight average granule size of between approximately 0.32 and 0.51 mm. In certain embodiments, granules 32 may have a weight average granule size of approximately 0.42 mm.

In one or more embodiments, third hopper 40 may be positioned over a second peak roller 46, from which asphaltic sheet 16 extends downward in both directions. Granules 44 are therefore dispensed over an arcuate portion of the upper surface of asphaltic sheet 16 as it curves or bends around second peak roller 46 similar to the application of granules 32 discussed above. In one or more embodiments, second peak roller 46 may have a diameter of between 15.0 and 25.0 inches. The diameter of second peak roller 46, and the bending or stretching of the top surface of asphaltic sheet 16 as is passes over second peak roller 46, may be adjusted to improve coverage of the third coating of granules 44 based upon coverage achieved by the first and second coatings 24 and 32, and the particle size of the granules 44 forming the third coating.

In one or more embodiments, granule coated asphaltic sheet 16 may be drawn beneath a roller or slating drum 34, or a pair of rollers 34 and 35 as shown in FIG. 1, that acts to compress asphaltic sheet 16 and granules 24, 32 and 44 to improve adhesion therebetween. If a pair of rollers is provided then the rollers 34 and 35 may be calendar rolls, as are well known in the art. In one or more embodiments, one or both of rolls 34, 35 may be cooled to a temperature below that of the ambient temperature to further cool asphaltic sheet 16 prior to rolling and storage of the sheet.

It is contemplated that the various steps of the method disclosed herein may be provided in any combination, as will be understood by those skilled in the art. For example, in one or more embodiments, a third coating of granules may be applied. In other embodiments, the vibration station 26 may be omitted along with the slating drum or pair of compression rollers 34 and 35 without deviating from the scope of the invention. In still other embodiments, a slating drum may be provided after each application of granules to asphaltic sheet 16 to improve adhesion of the granules to the asphaltic sheet.

It is also contemplated that the step of dropping granules over an arcuate upper surface of an asphalt sheet may be modified so that the granules are deposited onto the upper surface of the asphalt sheet immediately prior to passing over or around a radiused surface. It is believed that passing the asphaltic sheet over a radiused surface while the granules are resting on the sheet may allow the granules to fill the enlarged voids between the first coating of granules, similar to dropping the granules onto an arcuate upper surface of the asphaltic sheet as discussed herein. It will be appreciated by those skilled in the art that the second and third, and any subsequent drops of granules, may be modified so that the granules are not deposited directly onto the arcuate upper surface of an asphaltic sheet, but instead are deposited immediately prior to the asphaltic sheet being manipulated into an arcuate orientation.

In one particular embodiment of the invention, asphaltic sheet 16 receives a first coating of full grade granules from a first hopper. The granule coated sheet is then drawn beneath a slating drum to compress the sheet and granules together to improve adhesion. The granule coated asphaltic sheet then proceeds beneath a second vibratory hopper where a second coating of fine granules is applied to an arcuate upper surface of the sheet while it passes over or around a peak roller. After passing through a series of cooling rollers, the twice granule coated sheet is then heated by a heating element and receives a third coating of fine granules before passing beneath a second slating drum. The granule coated asphaltic sheet may then be rolled for storage or shipping.

In order to demonstrate the practice of the present invention, the following comparative studies have been performed. The examples should not, however, be viewed as limiting the scope of the invention. The claims will serve to define the invention.

EXAMPLES

Comparative Study 1

An asphaltic sheet having a reinforcing sheet was prepared using conventional techniques. A polyester and glass reinforcing mat was drawn through a dip tank containing an SBS asphalt composition to form an asphalt sheet, and the asphalt sheet then passed through a pair of calendar rollers.

Figure 2:
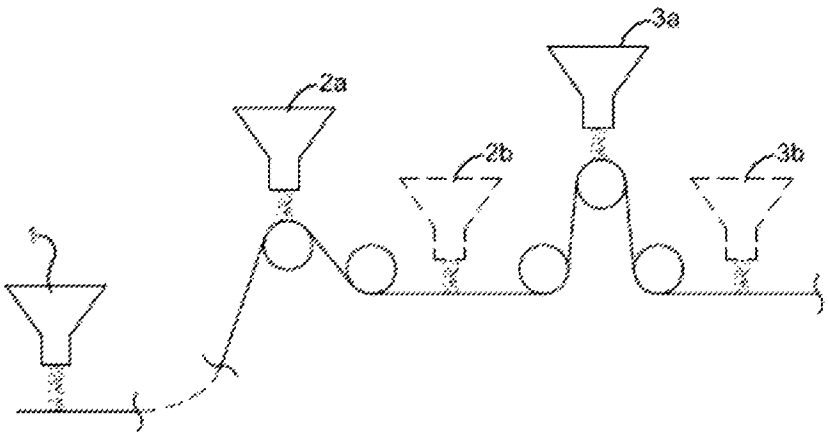
FIG. 2 is a schematic view illustrating the comparative study performed and summarized in Table I.

Referring to FIG. 2, a first coating of reflective granules was applied to the asphaltic sheet (1), and the granule coated sheet then passed around a slating drum to press the first coating of granules into the top surface of the asphaltic sheet. The granules were dropped from a hopper to form the first coating had a weight average particle size of approximately 1.22 mm. The temperature of the asphaltic sheet at the location of the first drop was approximately 350° F. The asphaltic sheet then floated across a cooling tank to reduce the temperature of the sheet. The asphaltic sheet was then inverted through a series of rollers which caused the excess non-adhered granules to fall from the top surface of the asphaltic sheet.

In a first trial, second and third coatings of granules were applied to the asphaltic sheet, with the third coating being applied over an arcuate upper surface of the asphaltic sheet (3*a*), and the location of the application of the second coating of granules was varied between an arcuate upper surface (2*a*) and a flat upper surface (2*b*). The granules were dropped from a hopper in each instance, and had a weight average particle size of approximately 0.42 mm. The temperature of the asphaltic sheet at the location of the second drop was approximately 225° F., and following the second drop the asphaltic sheet was routed through a series of cooling rollers to further reduce the temperature of the sheet. The asphaltic sheet was heated to a temperature of approximately 135° F. prior to the third drop. The reflectivity of the resulting granule coated asphaltic sheet was measured in each instance, the reflectivity of the sheet being an indicator of surface coverage of the granules.

The average reflectivity when the second drop was applied over an arcuate upper surface of the asphaltic sheet was 71.3% with a standard deviation of 0.6%. The average reflectivity when the second drop was applied over a flat upper surface of the asphaltic sheet was 69.7% with a standard deviation of 0.5%. Thus, the first trial shows that application of the second coating of granules on an arcuate upper surface of the asphaltic sheet results in improved reflectivity, and therefore improved surface coverage, as compared with a flat surface drop.

In a second trial, second and third coatings of fine granules were applied to the asphaltic sheet, with the second coating being applied over an arcuate upper surface of the asphaltic sheet (2*a*), and the location of the application of the third coating of granules was varied between an arcuate upper surface (3*a*) and a flat upper surface (3*b*). The method employed in the second trial was otherwise substantially identical the method of the first trial discussed above. The reflectivity of the resulting granule coated asphaltic sheet was measured in each instance, the reflectivity of the sheet being an indicator of surface coverage of the granules.

The average reflectivity when the third drop was applied over an arcuate upper surface of the asphaltic sheet was 71.3% with a standard deviation of 0.3%. The average reflectivity when the third drop was applied over a flat upper surface of the asphaltic sheet was 71.0% with a standard deviation of 0.2%. Thus, the second trial shows that application of the third coating of granules on an arcuate upper surface of the asphaltic sheet results in improved reflectivity, and therefore improved surface coverage, as compared with a flat surface drop.

In a third trial, second and third coatings of fine granules were applied to the asphaltic sheet, with both coatings being applied over an arcuate upper surface of the asphaltic sheet (2*a* and 3*a*), and alternatively, with both coatings being applied over a flat upper surface of the asphaltic sheet (2*b* and 3*b*). The method employed in the third trial was otherwise substantially identical the method of the first trial discussed above. The reflectivity of the resulting granule coated asphaltic sheet was measured in each instance, the reflectivity of the sheet being an indicator of surface coverage of the granules.

The average reflectivity when both the second and third drops were applied over an arcuate upper surface of the asphaltic sheet was 71.3% with a standard deviation of 0.5%. The average reflectivity when both the second and third drops were applied over a flat upper surface of the asphaltic sheet was 69.4% with a standard deviation of 0.2%. Thus, the third trial again shows that application of the second and/or third coatings of granules over an arcuate upper surface of the asphaltic sheet results in improved reflectivity, and therefore improved surface coverage, as compared with dropping the granules on a flat upper surface of the asphaltic sheet.

Table 1 below summarizes the trials discussed above.

TABLE I

| | | | | | | AVE | STDEV |
|---|---|---|---|---|---|---|---|
| Reflectivity (%) - Drop #2 Varies, Drop # 3 Arcuate | | | | | | | |
| Arcuate | 71.8 | 71.5 | 70.2 | 71.6 | 71.3 | 71.3 | 0.60 |
| Flat | 70.1 | 69.0 | 70.4 | 69.2 | 69.8 | 69.7 | 0.50 |
| Reflectivity (%) - Drop #3 Varies, Drop #2 Arcuate | | | | | | | |
| Arcuate | 71.5 | 70.9 | 71.2 | 71.5 | 71.5 | 71.3 | 0.30 |
| Flat | 70.9 | 70.6 | 71.3 | 71.1 | 71.0 | 71.0 | 0.20 |
| Reflectivity (%) - Drops #2 and #3 Vary | | | | | | | |
| Arcuate | 71.8 | 71.2 | 70.9 | 71.8 | 70.7 | 71.3 | 0.50 |
| Flat | 69.4 | 69.7 | 69.2 | 69.5 | 69.1 | 69.4 | 0.20 |

As can be seen from the results in Table 1, the reflectivity of the resulting granule coated asphaltic article was higher in each instance where granules were deposited at an apex of the asphaltic sheet. The increased reflectivity indicates better granule coverage over asphaltic sheet 16 achieved by applying the second and/or third coating of granules at an apex of the asphaltic sheet.

Comparative Study 2

An asphaltic sheet having a first coating of reflective full grade granules was prepared as discussed in Comparative Study I. Second and third coatings of reflective granules were deposited over an arcuate top surface of the asphaltic sheet at second and third hoppers, each positioned over a peak roller. The particle size of the reflective granules used to form the second and third coatings was varied, and the resulting reflectivity of the granule coated asphaltic article in each instance is shown in Table 2. In each test, the second and third drops utilized the same granule particle size.

The particle size of the Standard Fines used in the study was between 0.33 and 0.51 mm with a weight average particle size of 0.42. For each successive trial, the granules were sieved to remove smaller particles below a minimum threshold. Thus, for the trials using granules having a particle size of >0.4 mm, the standard fines were sieved to remove granules with a particle size less than 0.4 mm, and the remainder of the granules remaining on the sieve were used at the second and third drops. A similar process was used to obtain the desired granules for the successive trials using larger granules.

TABLE II

| Sample Size | Weight Ave. Granule Size | Reflectivity (%) with variable granule size at Drops 2 and 3 | | | | | AVG | STDEV |
|---|---|---|---|---|---|---|---|---|
| Standard Fines | 0.42 | 72.2 | 72.8 | 72.1 | 72.0 | 72.4 | 72.3 | 0.3 |
| >0.4 mm Only | 0.67 | 72.0 | 72.0 | 72.6 | 71.5 | 72.5 | 72.1 | 0.4 |
| >0.6 mm Fines | 0.72 | 72.5 | 71.9 | 72.4 | 73.0 | 72.5 | 72.5 | 0.4 |
| >0.8 mm Only | 1.18 | 69.0 | 66.9 | 68.3 | 68.2 | 67.5 | 68.0 | 0.7 |
| >1.0 mm Only | 1.28 | 66.9 | 65.8 | 65.2 | 65.5 | 66.1 | 65.9 | 0.6 |
| >1.2 mm Only | 1.35 | 65.1 | 64.5 | 64.7 | 63.8 | 62.3 | 64.1 | 1.0 |

Table 2 shows improved reflectivity where the particle size of the granules forming the second and third coatings of granules are less than 0.8 mm, as compared to the larger granule sizes of 0.8, 1.0 and 1.2 mm. It is also apparent from the data that the benefits of using granules with a smaller particle size levels out at approximately 0.4 mm, and that further reductions in particle size do not yield significant improvements in reflectivity of the resulting asphaltic sheet.

Various other modifications and alterations that do not depart from the scope and spirit of this invention will become apparent to those skilled in the art. This invention is not to be unduly limited to the illustrative embodiments set forth herein.

The invention claimed is:

1. A method for manufacturing an asphaltic sheet, the method comprising:

i. providing an asphaltic sheet with first and second planar surfaces, said first surface carrying a plurality of granules;

ii. passing the asphaltic sheet over a radiused surface to create an arcuate upper surface on the first planar surface; and iii. dropping granules onto the arcuate upper surface.

2. The method of claim 1, where the radiused surface includes a roller.

3. The method of claim 2, where the roller has a radius of between 5.0 and 35.0 inches.

4. The method of claim 1, further including the step of heating the asphaltic sheet prior to said step of passing the asphaltic sheet over a radiused surface.

5. The method of claim 1, further including tensioning the asphaltic sheet during said step of passing the asphaltic sheet over a radiused surface.

6. The method of claim 1, where said step of passing the asphaltic sheet over a radiused surface causes the asphaltic sheet to be bent at an angle of less than 180 ° .

7. A method of manufacturing an asphaltic sheet, the method comprising the steps of:

i. providing an asphaltic sheet having a plurality of granules disposed on a first surface of the asphaltic sheet;

ii. manipulating the asphaltic sheet to form an arcuate upper surface on the first surface; and iii. depositing a plurality of granules onto the arcuate upper surface.

8. The method of claim 7, where said step of manipulating includes passing the asphaltic sheet over a radiused surface.

9. The method of claim 8, where the radiused surface includes a roller.

10. The method of claim 9, where the roller has a radius of between 5.0 and 35.0 inches.

11. The method of claim 7, where said step of manipulating further includes stretching the top surface of the asphaltic sheet.

12. A method of applying granules to asphaltic sheet, the method comprising:

i. providing an asphaltic sheet having a first planar surface and an opposed bottom surface, said first planar surface having granules disposed on the first planar surface of the asphaltic sheet;

ii. stretching the first planar surface of the asphaltic sheet while compressing the opposed bottom planar surface of the asphaltic sheet to thereby expand interstices that exist between the granules disposed on the upper planar surface of the asphaltic sheet; and iii. dropping granules onto the first planar surface of the asphaltic sheet during said step of stretching the upper surface of the asphaltic sheet.

* * * * *